US008743018B2

(12) United States Patent
Yamada

(10) Patent No.: US 8,743,018 B2
(45) Date of Patent: Jun. 3, 2014

(54) METAMATERIAL

(75) Inventor: Daisuke Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 318 days.

(21) Appl. No.: 13/349,496

(22) Filed: Jan. 12, 2012

(65) Prior Publication Data

US 2012/0182202 A1 Jul. 19, 2012

(30) Foreign Application Priority Data

Jan. 14, 2011 (JP) ..... 2011-006380

(51) Int. Cl.
*H01Q 15/02* (2006.01)

(52) U.S. Cl.
USPC ..... 343/909

(58) Field of Classification Search
USPC ..... 343/907–908, 911 R; 359/238, 245; 333/219, 204, 238
See application file for complete search history.

(56) References Cited

U.S. PATENT DOCUMENTS 7,561,320 B2 * 7/2009 Wang et al. ..... 359/238
7,940,228 B1 * 5/2011 Buckley ..... 343/810
8,300,294 B2 * 10/2012 Wu et al. ..... 359/240
8,315,500 B2 * 11/2012 Li et al. ..... 385/147
2007/0215843 A1 9/2007 Soukoulis
2008/0165079 A1 * 7/2008 Smith et al. ..... 343/911 R

OTHER PUBLICATIONS

Shuang et al., Experimental Demonstration of Near-Infrared Negative-Index Metamaterials, The American Physical Society, Sep. 23, 2005, pp. 137404-1-137404-4, New York, NY.

* cited by examiner

*Primary Examiner* — Huedung Mancuso
(74) *Attorney, Agent, or Firm* — Canon U.S.A., Inc. IP Division

(57) ABSTRACT

A metamaterial comprising a plurality of unit lattices which are arrayed on a plane in a two dimensional manner and are laminated, wherein a dielectric layer is formed from a first dielectric section and a second dielectric section that is present on the same plane as the first dielectric section and has a smaller refractive index than that of the first dielectric section, wherein the first dielectric section is arranged on an upper side or a lower side of the metal cross layer forming the unit lattice including at least a portion of the crossing region, and wherein the second dielectric section is arranged on an upper side or a lower side of the metal cross layer forming the unit lattice including at least a portion of the non-crossing region.

4 Claims, 15 Drawing Sheets

METAMATERIAL

BACKGROUND OF THE INVENTION

1. Field of the Invention

The present invention relates to a metamaterial having a specific refractive index such as a negative refractive index in an electromagnetic field including light.

2. Description of the Related Art

A metamaterial has been discussed in recent years. The metamaterial is a material that is artificially formed from a metal, a dielectric substance, a magnetic substance and the like in a structure that is smaller than a wavelength of an incident light and artificially changes a permittivity and a permeability of a medium.

If the metamaterial is configured to have negative values in both of the permittivity and the permeability, a negative refractive index can be obtained. New optical phenomena such as image formation over a diffraction limit (complete image formation) can be obtained using the negative refractive index. Impedance can be arbitrary controlled by independently controlling the permittivity and the permeability, and thus, a structure in which complete reflection and a reflectivity are reduced can be obtained.

In addition to the above, it has been discussed to apply new optical properties that do not occur in the nature by controlling the permittivity and the permeability. A structure in which unit lattices having a micro-resonator are arrayed in matrices has been discussed as a structure in which the permittivity and the permeability are artificially controlled in Physical Review Letter, 95: 137404 (2005 (hereinafter referred to as a "non-patent literature 1").

However, when the structure described in the non-patent literature 1 is applied to a region with a short wavelength such as a near-infrared region and a visible region, it is necessary to shorten a resonance wavelength of a magnetic field or an electric field. To shorten the resonance wavelength, the unit lattice (micro-resonator) could be further downsized simply. However, a size of the unit lattice in the near-infrared region and the visible region becomes approximately 100 nm or smaller, and it becomes very difficult to fabricate such a structure.

SUMMARY OF THE INVENTION

The present invention relates to a metamaterial in which a resonance wavelength can be shortened without further downsizing a unit lattice when the metamaterial having a structure in which the unit lattices having a micro-resonator are arrayed in matrices is configured.

According to an aspect of the present invention, a metamaterial includes unit lattices which are arrayed on a plane in a two dimensional manner and are laminated, wherein the unit lattice includes a metal cross layer and a dielectric layer, wherein the metal cross layer includes a first pillar section along a first axis on the plane and a second pillar section along a second axis that is present on the same plane as the first axis and intersects with the first axis, and includes a cross structure formed by a crossing region in which the first pillar section is intersected with the second pillar section and a non-crossing region in which the first pillar section is not intersected with the second pillar section, wherein the dielectric layer is formed from a first dielectric section and a second dielectric section that is present on the same plane as the first dielectric section and has a smaller refractive index than that of the first dielectric section, wherein the first dielectric section is arranged on an upper side or a lower side of the metal cross layer forming the unit lattice including at least a portion of the crossing region, and wherein the second dielectric section is arranged on an upper side or a lower side of the metal cross layer forming the unit lattice including at least a portion of the non-crossing region.

According to the present invention, the metamaterial in which the resonance wavelength can be shortened without further downsizing the unit lattice when the metamaterial having the structure in which the unit lattices having the micro-resonator are arrayed in matrices is configured can be realized.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
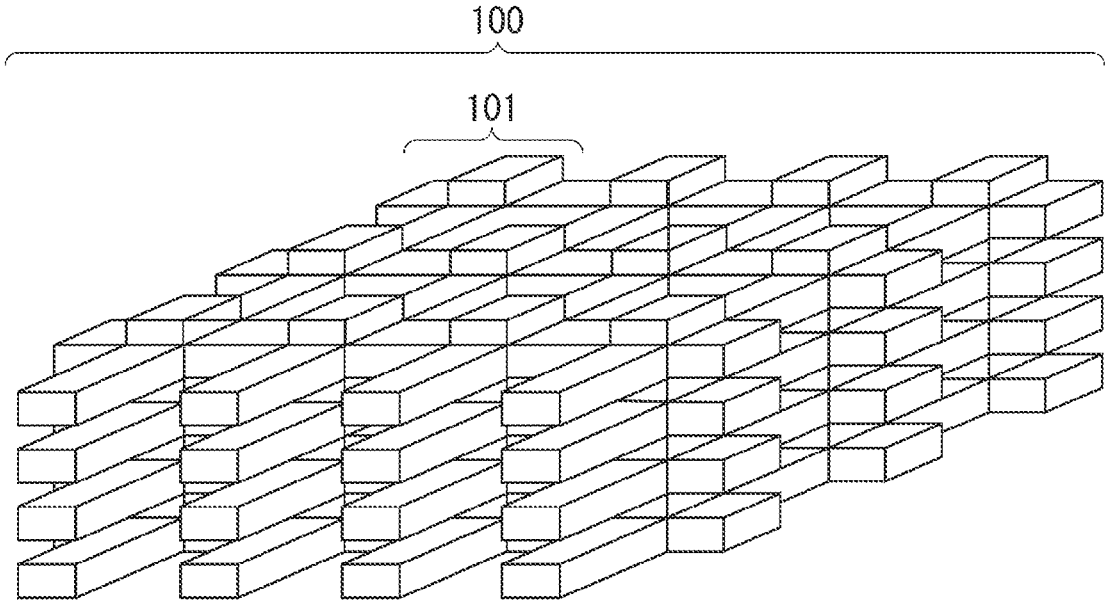
FIG. 1 is a schematic view illustrating an example of a configuration of a metamaterial according to a first exemplary embodiment of the present invention.

Various exemplary embodiments, features, and aspects of the invention will be described in detail below with reference to the drawings.

The same reference numerals are given to those having the similar function in all of the figures, and their repeated explanation is omitted.

A configuration example of a metamaterial 100 to which the configuration of the present invention is applied is described as a first exemplary embodiment with reference to FIG. 1. FIG. 1 illustrates the metamaterial 100. The metamaterial 100 of the present exemplary embodiment is configured by arraying unit lattices 101 on a plane in a two dimensional manner and laminating them.

Figure 2A:
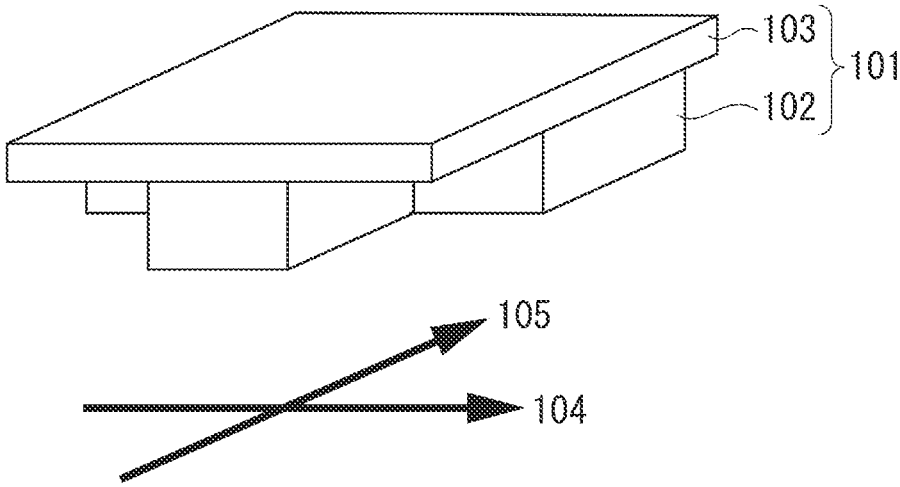
FIGS. 2A to 2C illustrate a structure of a unit lattice according to the first exemplary embodiment of the present invention.
Figure 2B:
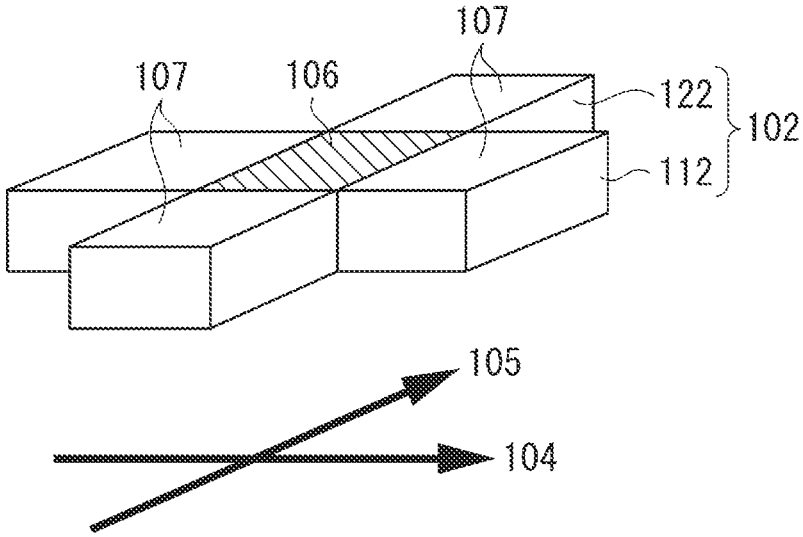
Figure 2C:
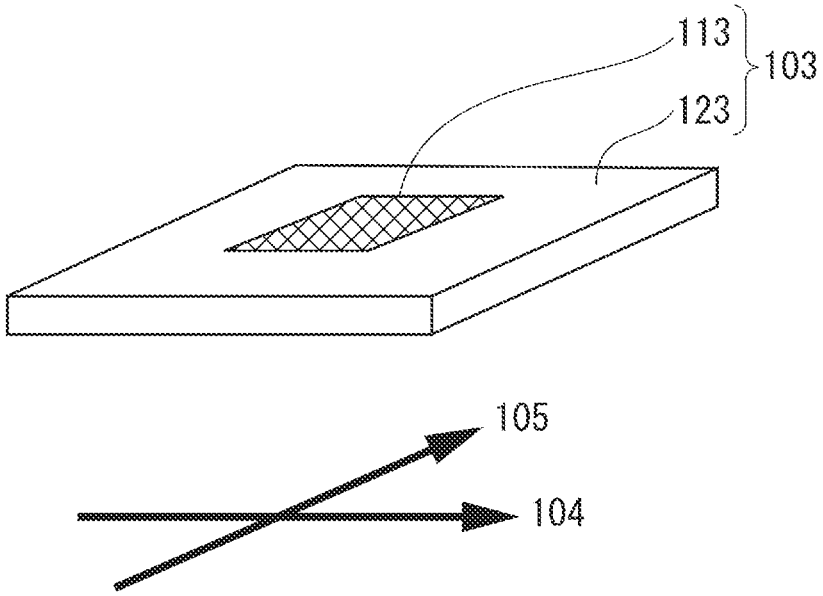

FIGS. 2A to 2C illustrate the configuration of the unit lattice 101. As illustrated in FIG. 2A, the unit lattice 101 includes a metal cross layer 102 made of a metal and a dielectric layer 103 made of a dielectric substance. Also as illustrated in FIG. 2B, the metal cross layer 102 includes a first metal pillar section 112 along a first axis 104 and a second metal pillar section 122 along a second axis 105 that is present on the same plane as the first axis and intersects with the first axis. A cross structure is formed by a crossing region 106 in which the first pillar section 112 is intersected with the second pillar section 122 and a non-crossing region 107 in which they are not intersected with the crossing region 106.

As illustrated in FIG. 2C, the dielectric layer 103 in the above-described unit lattice 101 includes a first dielectric section 113 and a second dielectric section 123, and is arranged on an upper side of the metal cross layer 102 that composes the unit lattice. The first dielectric section 113 is arranged directly above the metal cross layer including at least a portion of the crossing region 106. The second dielectric section 123 is present on the same plane as the first dielectric section 113 and is arranged directly above the metal cross layer including at least a portion of the non-crossing region 107. The resonance wavelength can be shortened without downsizing the unit lattice by making the refractive index of the second dielectric section 123 smaller than the refractive index of the first dielectric section 113 at that time.

The dielectric layer 103 is arranged on the upper side of the metal cross layer 102 that composes the unit lattice in the example illustrated in FIG. 2A to 2C. However, the dielectric layer can be arranged between the metal cross layers in the metamaterial having the laminated structure illustrated in FIG. 1. Thus, the dielectric layer 103 is not limited to being arranged on the upper side of the metal cross layer 102, and may be arranged on a lower side of the metal cross layer 102. Likewise, the metal cross layer 102 is a portion of the unit lattices arrayed in the two dimensional manner in the metamaterial 100. Thus, the metal cross layer 102 may have the structure other than the cross structure according to the configuration of the unit lattices. However, in such a case, if the unit lattices are configured to make the cross structure, the effects of the present invention can be obtained.

A principle that the resonance wavelength can be shortened is described below. First, it is described with reference to FIG. 3 that the permeability (or the permittivity) is changed using the resonance phenomenon of a magnetic (or electric) resonator present in the metamaterial 100.

Figure 3:
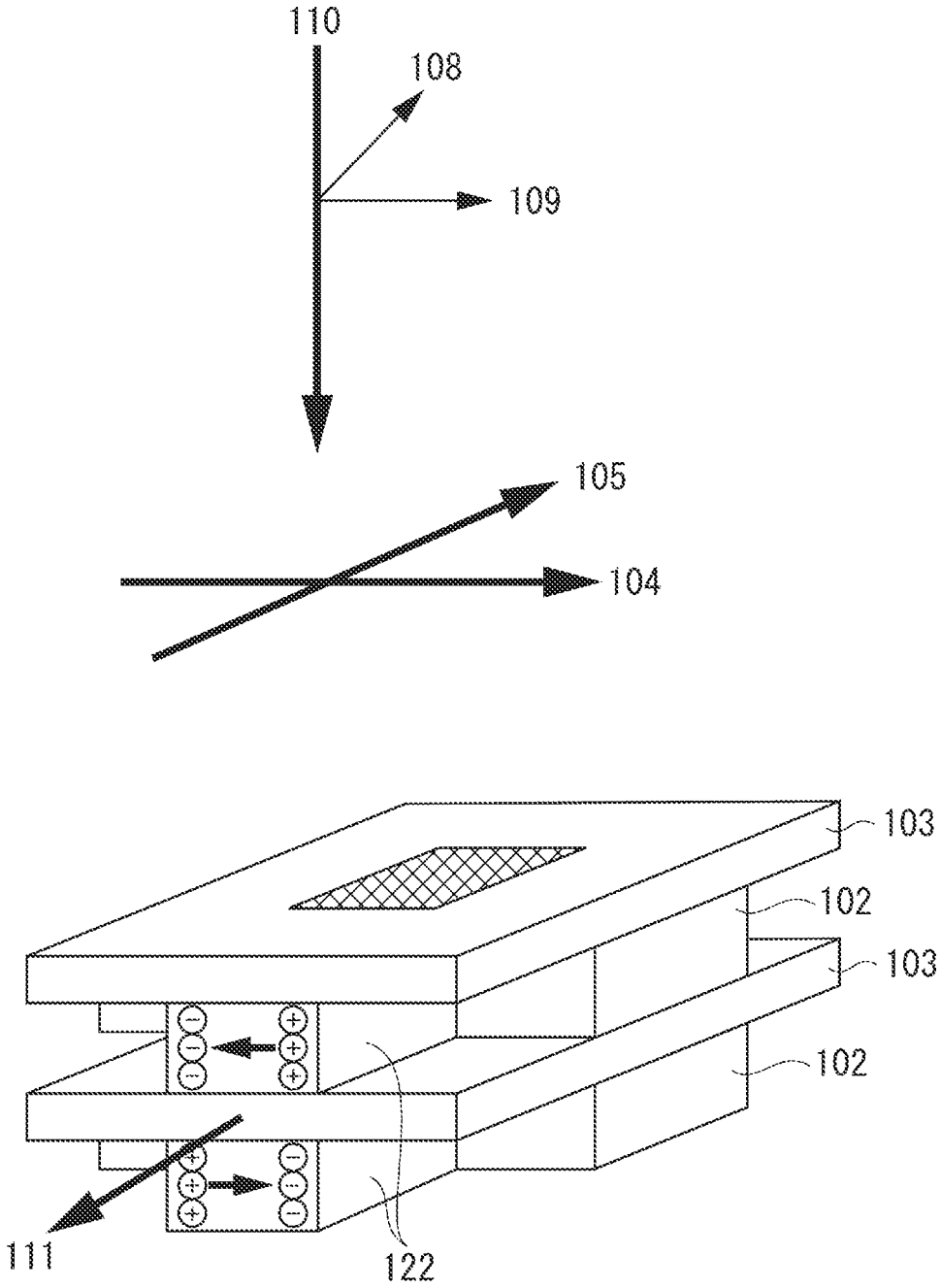
FIG. 3 illustrates that a permeability is changed using a resonance phenomenon of a magnetic resonator present in the metamaterial according to the first exemplary embodiment of the present invention.

FIG. 3 illustrates the case where light 110 of the resonance wavelength enters the metamaterial 100. An oscillating magnetic field 108 of the light 110 enters in parallel with the second axis 105 and an oscillating electric field 109 of the light 110 enters in parallel with the first axis 104. A force toward a direction of the oscillating electric field 109 of the incident light is given to free electrons in the metal, which move toward a direction of the first axis 104 in the metal cross layer 102.

Figure 4:
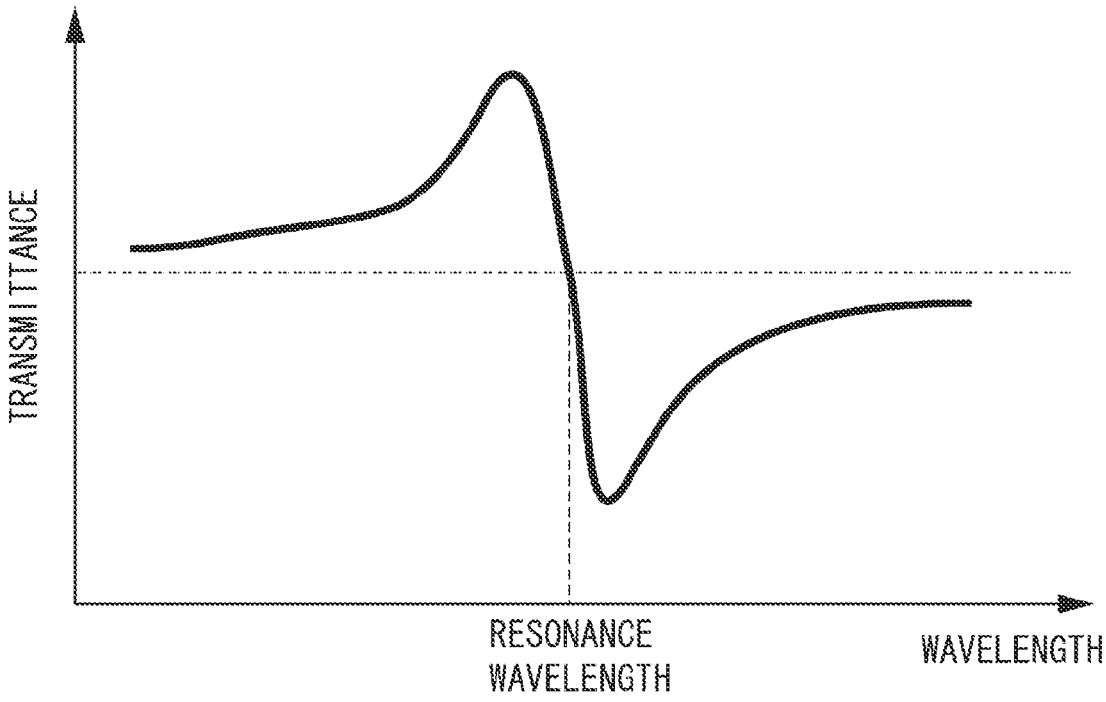
FIG. 4 illustrates a relationship between the permeability and the wavelength for describing that the metamaterial according to the first exemplary embodiment of the present invention resonates at a certain wavelength (frequency) to change the permeability (refractive index).

However, the metamaterial 100 has the structure in which the unit lattices are laminated, and as illustrated in FIG. 3, the direction of the free electrons that move in the metal cross layer is opposite one another because a phase is different according to a laminated direction. In particular, the free electrons that move in the non-crossing region 107 of the second pillar section 122 produce an imbalance (rough and dense) because they cannot move in edges of the metal. A magnetic field 111 is generated in the direction opposed to the oscillating magnetic field 108 of the incident light from the movement of the above free electrons according to Ampere's Law. Thus, as illustrated in FIG. 4, the metamaterial 100 resonates at the certain wavelength (frequency) to change the permeability (refractive index).

Subsequently, a principle that the resonance wavelength can be shortened by making the refractive index of the second dielectric section 123 smaller than the refractive index of the first dielectric section 113 is described.

In the dielectric layer 103 sandwiched between the metal cross layers, a charge is induced on the surface of the dielectric layer 103 from a charge accumulated in the metal cross layer. In particular, if the second dielectric section 123 having the small refractive index is formed on the non-crossing region 107 in which the imbalance of the charge in the metal is large, the charge amount induced on the surface of the second dielectric section 123 in contact with the metal cross layer becomes small.

If the charge induced on the surface of the dielectric layer becomes small, then the free electrons in the metal move easily (resistance is reduced), the number of the free electrons that contribute to the movement is increased, and consequently the large magnetic field 111 can be obtained. The magnetic field 111 is a component that is opposed to the magnetic field 108 of the incident light. Thus, when the magnetic field 111 is increased, the resonance wavelength is shortened. This corresponds to decrease capacitance in an inductance-capacitance (LC) resonator circuit. According to the above principle, by decreasing the refractive index of the second dielectric section 123, the resonance wavelength can be shortened without downsizing the unit lattice.

A numerical example according to the first exemplary embodiment is described below. A length of the unit lattice 101 in the direction of the first and second axes was 600 nm. A film thickness of the metal cross layer 102 was 30 nm, and a film thickness of the dielectric layer 103 was 60 nm. In the metal cross layer, a width of the first pillar section 112 was 400 nm and a width of the second pillar section 122 was 180 nm. The metal cross layer 102 was formed from silver, the first dielectric layer 113 was formed from magnesium fluoride (refractive index: 1.375), and the second dielectric layer 123 was formed from air (refractive index: 1.0).

Figure 5:
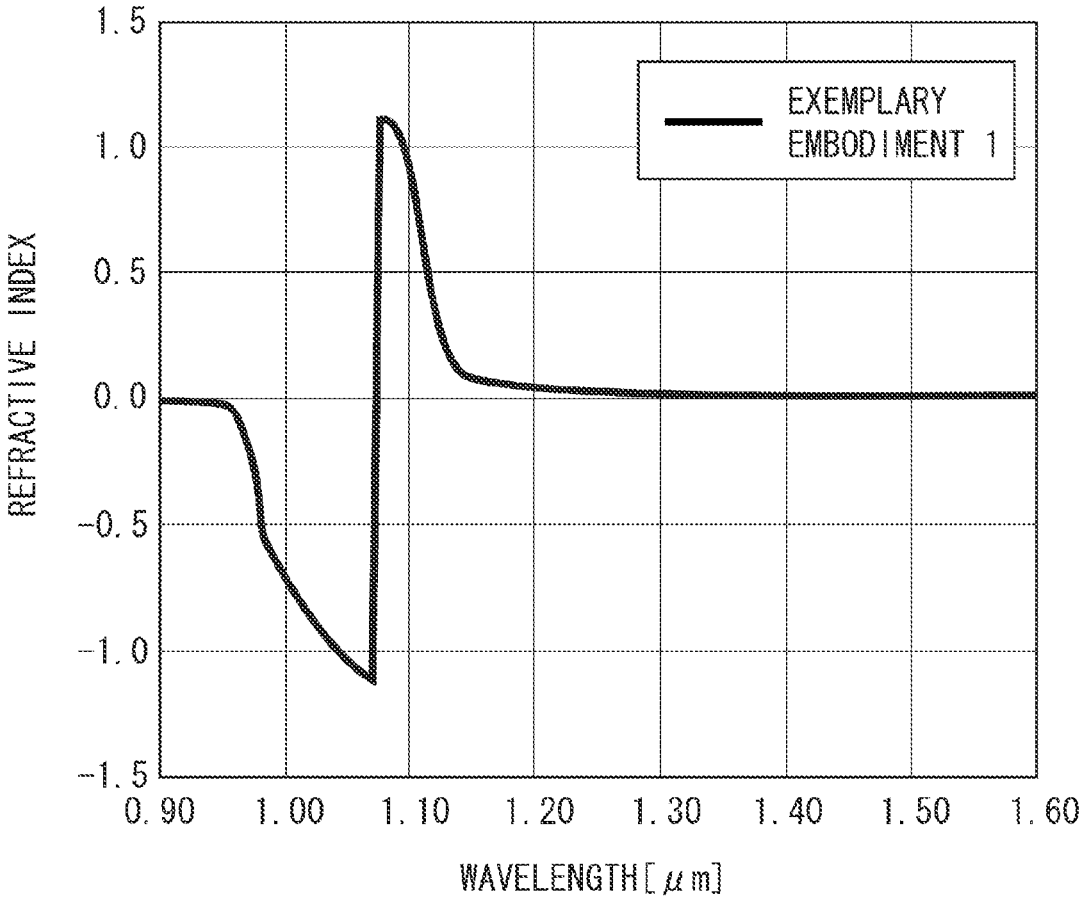
FIG. 5 illustrates the refractive index of the metamaterial for the wavelength of incident light of a numerical example according to the first exemplary embodiment of the present invention.

The refractive index of the metamaterial 100 for the wavelength of the incident light in the present numerical example of the first exemplary embodiment is illustrated in FIG. 5. The metamaterial resonated at a wavelength of 1.07 μm.

Figure 6:
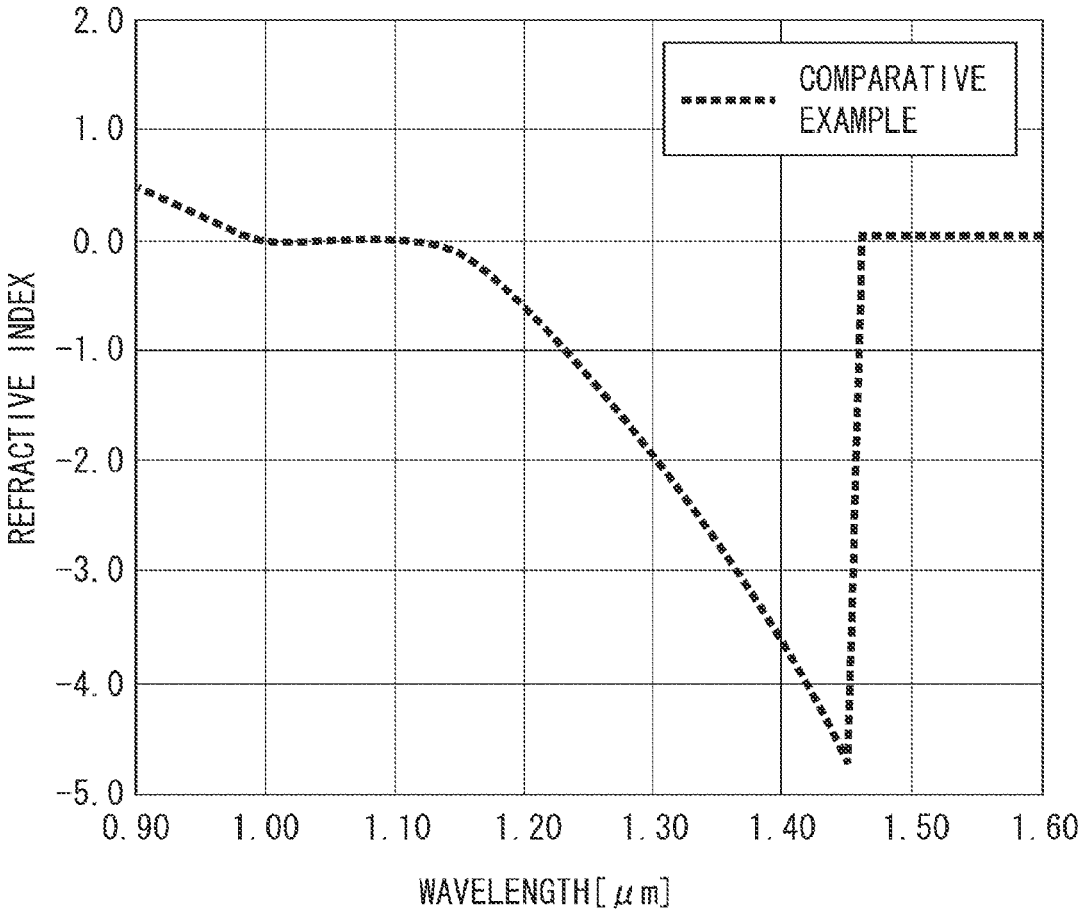
FIG. 6 illustrates a refractive index of a metamaterial when a unit lattice in which a dielectric layer has the same shape as that of a metal cross layer is used as an example of a comparative example.

The relationship between the refractive index and the wavelength of a metamaterial when a unit lattice including a dielectric layer having the same shape as that of a metal cross layer was used is illustrated in FIG. 6 as the example of a comparative example. The metamaterial resonated at a wavelength of 1.45 μm, which was the longer resonance wavelength compared with the present invention. In the example of the comparative example, the in-planar shape of the dielectric layer 103 was different from the present exemplary embodiment.

If a material having the refractive index of −1 is desired, the material is obtained at a wavelength of 1.04 μm according to the present exemplary embodiment whereas the material is obtained at a wavelength of 1.23 μm in the comparative example. Thus, in the present exemplary embodiment, the wavelength can be shortened in the unit lattice having the same size as in the conventional ones. The second dielectric layer was formed from the air in the present exemplary embodiment. This is because the effect on shortening the wavelength becomes large because the refractive index of the air is small, which is 1.0. However, the effect of the present invention can be also obtained even if the other material is used in which the refractive index of the second dielectric layer is smaller than the refractive index of the first dielectric layer.

Figure 7A:
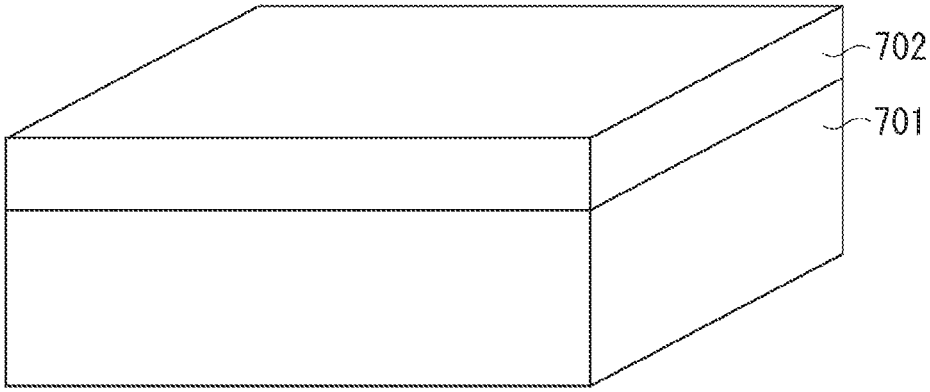
FIGS. 7A to 7C illustrate a method for manufacturing a metamaterial according to the first exemplary embodiment of the present invention.
Figure 7B:
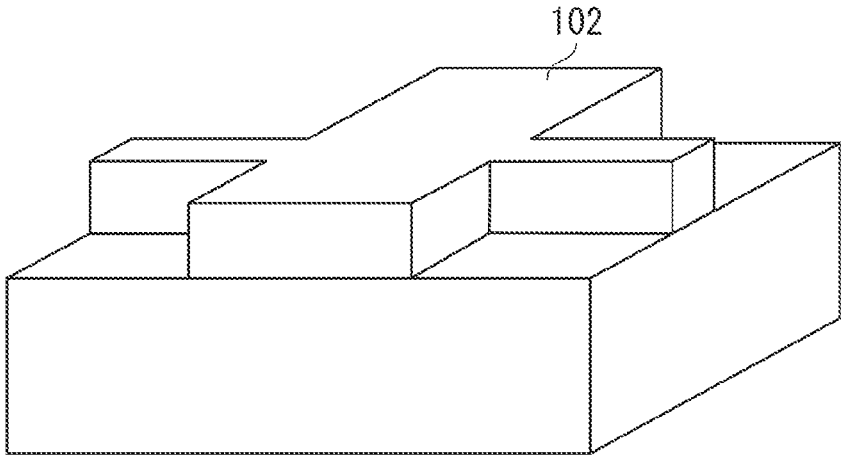
Figure 7C:
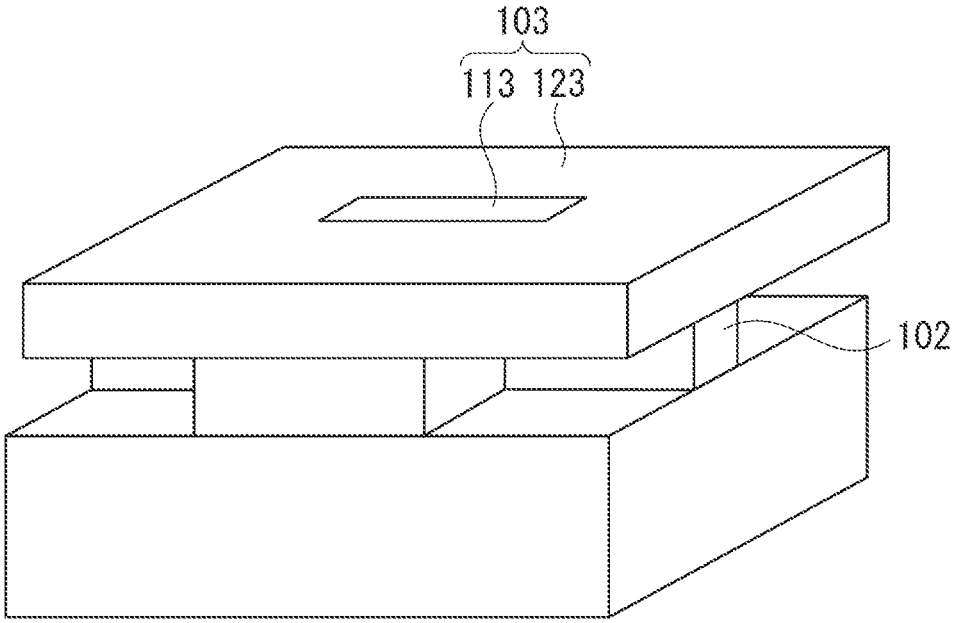

Subsequently, a method for manufacturing the metamaterial according to the present exemplary embodiment is described with reference to FIGS. 7A to 7C. First, to form the metal cross layer 102, a metal thin film 702 is formed by sputtering on a substrate 701 such as quartz (FIG. 7A).

Then, a resist film is patterned by lithography, and a metal is patterned by a dry etching step. Subsequently, the metal cross layer 102 is formed by removing the remaining resist by asking (FIG. 7B).

Then, to form the dielectric layer 103, a film of a dielectric substance for the first dielectric section is formed and the dielectric substance is likewise patterned by the lithography. Subsequently, a film of the second dielectric section is formed, and its surface is smoothened by a chemical mechanical polishing (CMP) method or the like (FIG. 7C).

The metamaterial 100 can be obtained by laminating the metal cross layer 102 and the dielectric layer 103 sequentially. The method for manufacturing the metamaterial by forming the layer one by one is illustrated in the above method. However, the metamaterial may be manufactured by first forming the metal thin film and the dielectric substance in a laminated structure on the substrate and subsequently forming layers by anisotropic etching using a focused ion beam (FIB) technique.

Figure 8:
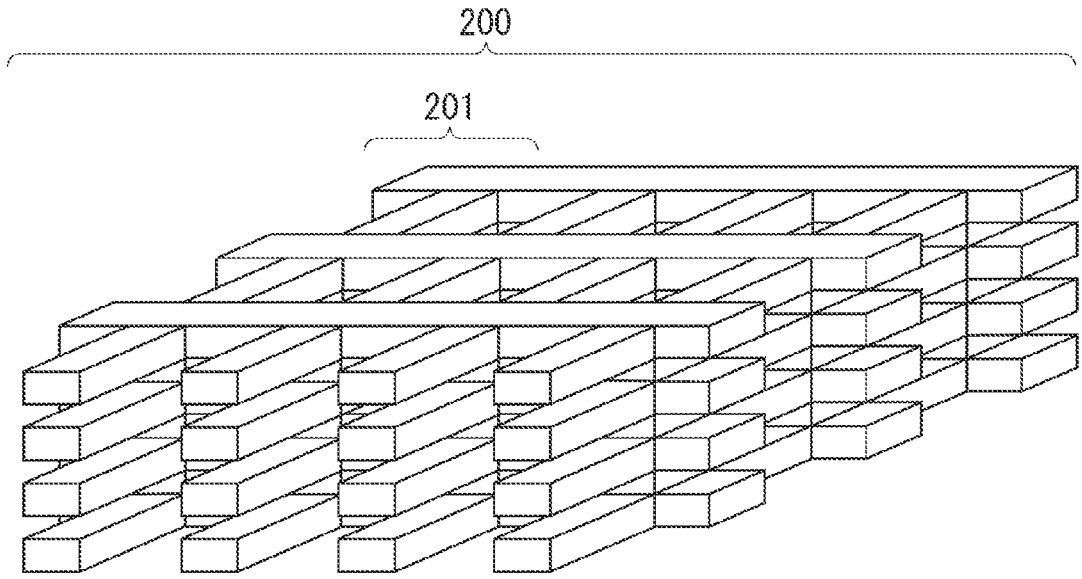
FIG. 8 is a schematic view illustrating an example of a configuration of a metamaterial according to a second exemplary embodiment of the present invention.

An example of the configuration of the metamaterial that is different in form from the above-described first exemplary embodiment is described as a second exemplary embodiment with reference to FIG. 8. FIG. 8 illustrates a metamaterial 200 and a unit lattice 201. In the second exemplary embodiment, only the shape of the dielectric layer is different from the first exemplary embodiment.

Figure 9A:
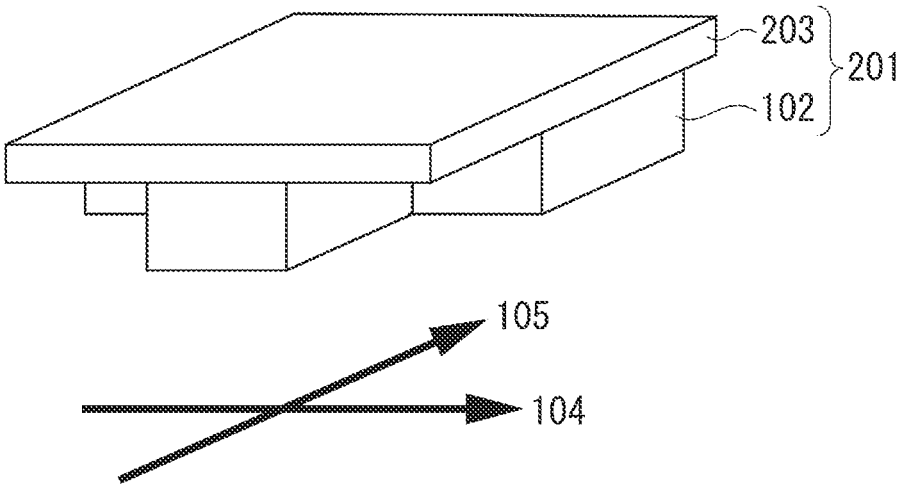
FIGS. 9A to 9C illustrate the configuration of a unit lattice according to the second exemplary embodiment of the present invention.
Figure 9B:
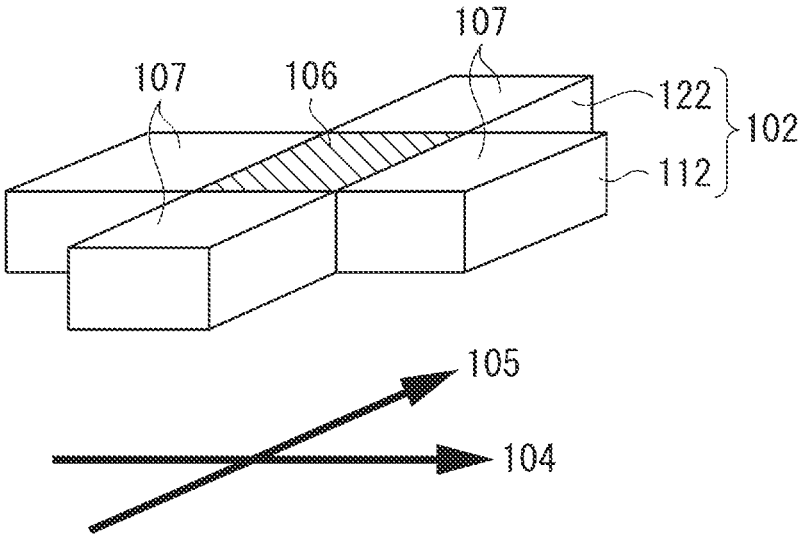
Figure 9C:
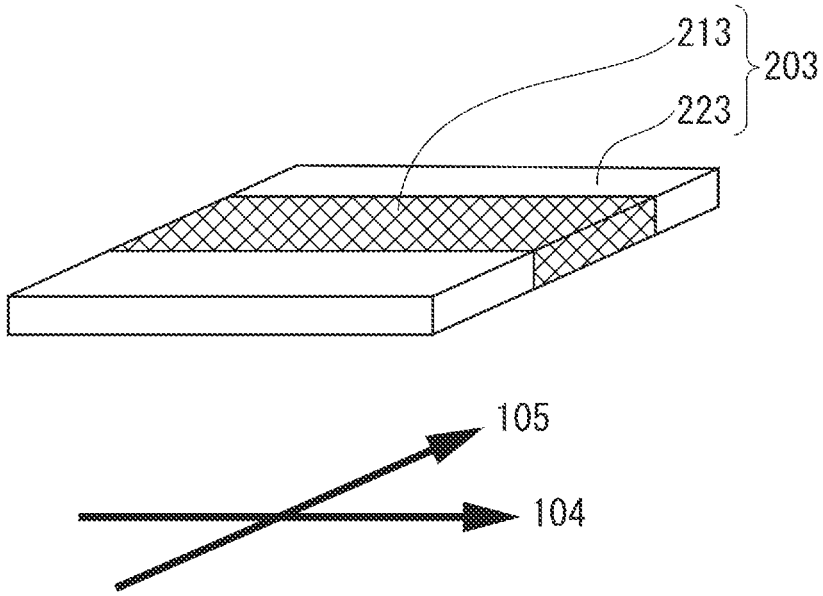

In a dielectric layer 203 of the present exemplary embodiment, as illustrated in FIGS. 9A to 9C, a first dielectric section 213 is arranged on the upper side of the first pillar section 112, and a second dielectric section 223 is arranged on both sides of this first dielectric section 213. More specifically, the first dielectric section 213 is arranged in contact with the crossing region 106 and the non-crossing region 107. In such a configuration, the dielectric layer 203 can be formed like strips of the first dielectric section and the second dielectric section, and can be manufactured easily.

The refractive index of the second dielectric section 223 is made smaller than that of the first dielectric section 213. Accordingly, an opposed magnetic field 111 produced by the magnetic resonator of the metamaterial 200 becomes larger due to the second dielectric section 223 formed on the upper side of the non-crossing region 107 of the second pillar section 122, so that the resonance wavelength can be shortened.

Figure 10:
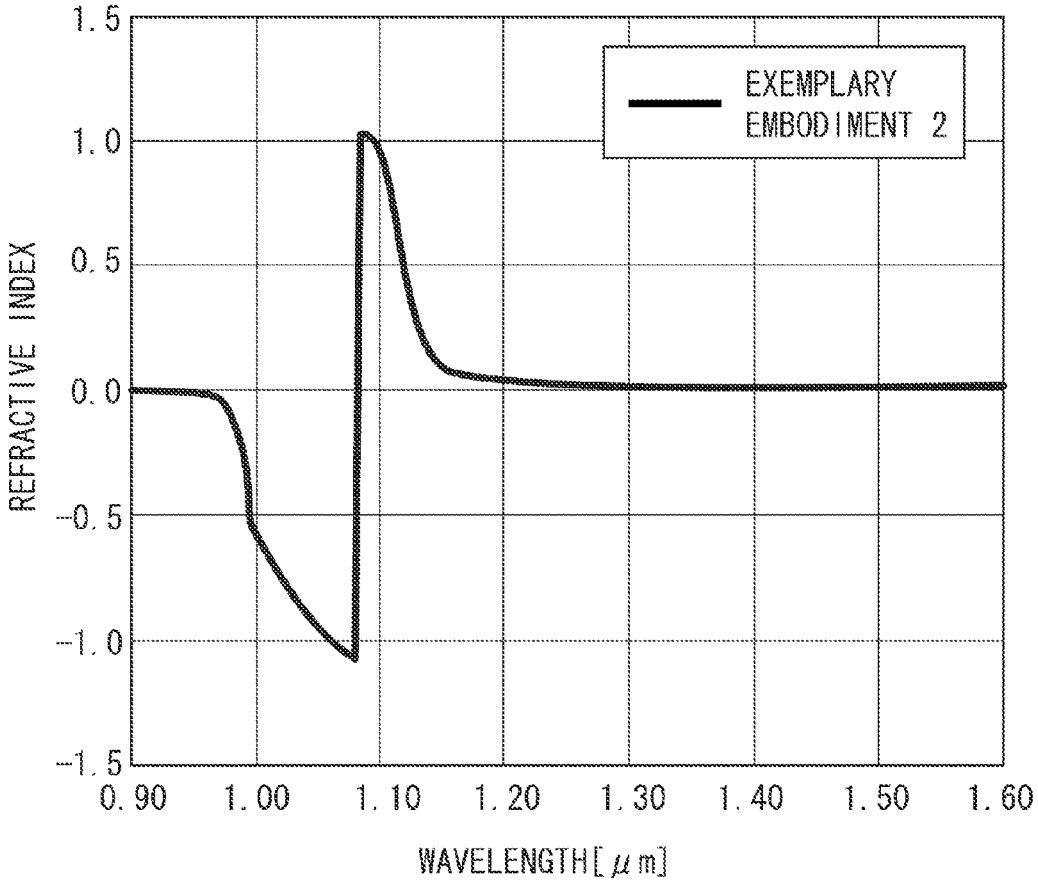
FIG. 10 illustrates the refractive index of the metamaterial for the wavelength of the incident light of a numerical example according to the second exemplary embodiment of the present invention.

A numerical example according to the second exemplary embodiment is described below. The width of the first dielectric section was 180 nm and the width of the second dielectric section was 420 nm. The other conditions were the same as in the first exemplary embodiment. The resonance wavelength at that time was 1.09 μm (FIG. 10), which was shortened compared with that of the comparative example illustrated in FIG. 6.

If a material having the refractive index of −1 is desired, the material is obtained at a wavelength of 1.07 μm in the present exemplary embodiment whereas the material is obtained at a wavelength of 1.23 μm in the comparative example. Thus, in the present invention, the wavelength can be shortened in the unit lattice having the same size as in the comparative example.

Figure 11A:
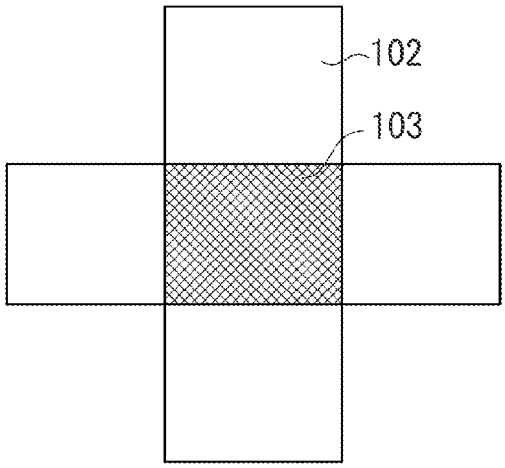
FIGS. 11A to 11F illustrate a configuration example in which a first dielectric section is arranged on an upper side of at least a portion of a crossing region according to the present invention.
Figure 11B:
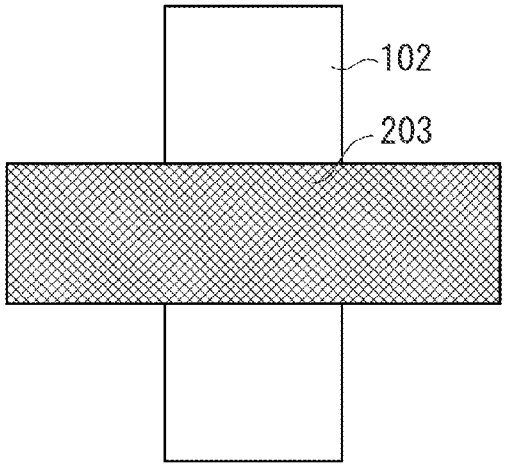
Figure 11C:
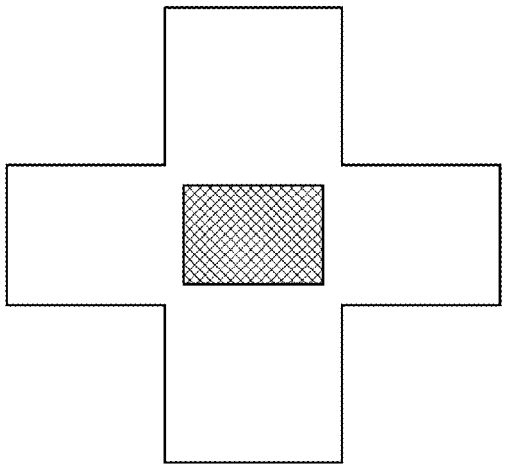
Figure 11D:
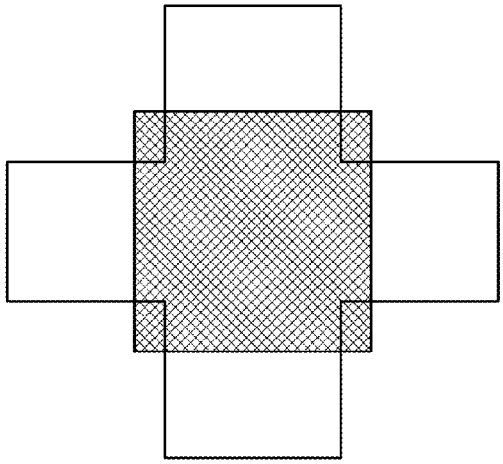
Figure 11E:
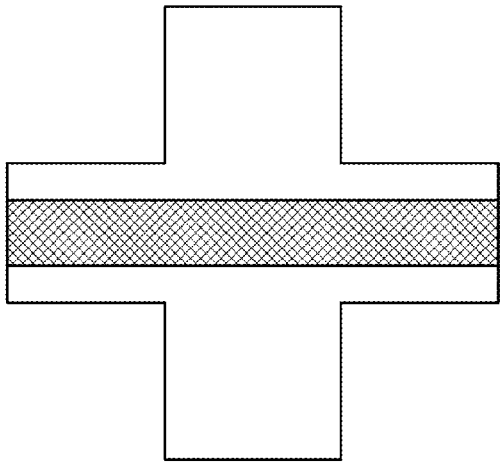
Figure 11F:
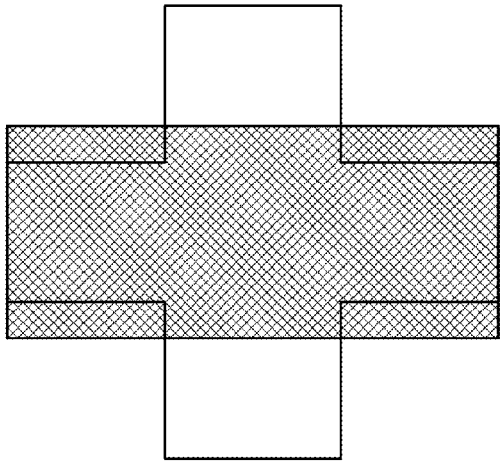

The first dielectric section in the same shape is arranged on the upper side of the crossing region 106 according to the first exemplary embodiment and is arranged on the upper side of the second pillar section in the second exemplary embodiment (FIGS. 11A and 11B). However, the present invention is not limited to these configurations, and the first dielectric section can be arranged on the upper or lower side of at least the portion of the crossing region 106.

For example, as illustrated in FIGS. 11C, 11D, 11E, and 11F, the first dielectric section may be contacted with the crossing region 106 in a smaller surface or a larger surface than the crossing region 106. However, when the first dielectric section is contacted with the crossing region in the smaller surface than the crossing region, the effect of shortening the resonance wavelength of the metamaterial is further increased.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims priority from Japanese Patent Application No. 2011-006380 filed Jan. 14, 2011, which is hereby incorporated by reference herein in its entirety.

What is claimed is:

1. A metamaterial comprising a plurality of unit lattices which are arrayed on a plane in a two dimensional manner and are laminated, wherein the unit lattice includes a metal cross layer and a dielectric layer, wherein the metal cross layer includes a first pillar section along a first axis on the plane and a second pillar section along a second axis that is present on the same plane as the first axis and that intersects the first axis, and includes a cross structure formed by a crossing region in which the first pillar section is intersected with the second pillar section and a non-crossing region in which the first pillar section is not intersected with the second pillar section, wherein the dielectric layer is formed from a first dielectric section and a second dielectric section that is present on the same plane as the first dielectric section and has a smaller refractive index than that of the first dielectric section, wherein the first dielectric section is arranged on an upper side or a lower side of the metal cross layer forming the unit lattice including at least a portion of the crossing region, and wherein the second dielectric section is arranged on an upper side or a lower side of the metal cross layer forming the unit lattice including at least a portion of the non-crossing region.

2. The metamaterial according to claim 1, wherein the first dielectric section is formed as a pillar section along the first axis.

3. The metamaterial according to claim 1, wherein the first dielectric section is arranged on an upper side or a lower side of a smaller region than the crossing region in the metal cross layer that forms the unit lattice.

4. The metamaterial according to claim 1, wherein the second dielectric section includes air.

* * * * *